US006057822A

United States Patent [19]

Tsubota

[11] Patent Number: 6,057,822

[45] Date of Patent: May 2, 2000

[54] LIQUID CRYSTAL DISPLAY DEVICE AND A METHOD FOR DRIVING THE SAME

[75] Inventor: Hiroyoshi Tsubota, Kanagawa, Japan

[73] Assignee: Sony Corporation, Tokyo, Japan

[21] Appl. No.: 08/870,279

[22] Filed: Jun. 6, 1997

[30] Foreign Application Priority Data

Jun. 20, 1996 [JP] Japan ..... P08-181568

[51] Int. Cl.[7] ..... G09G 3/36

[52] U.S. Cl. ..... 345/98; 345/87

[58] Field of Search ..... 345/95, 92, 93, 345/100, 99, 98, 211, 212, 213, 214, 84

[56] References Cited

U.S. PATENT DOCUMENTS

| | | | |
|---|---|---|---|
| 4,848,876 | 7/1989 | Yamakawa | 345/212 |
| 5,287,092 | 2/1994 | Shiraishi | 345/84 |
| 5,576,737 | 11/1996 | Isozaki | 345/212 |
| 5,745,105 | 4/1998 | Kim | 345/211 |
| 5,760,759 | 6/1998 | Tanaka et al. | 345/95 |
| 5,859,627 | 1/1999 | Hoshiya et al. | 345/100 |

*Primary Examiner*—Chanh Nguyen
*Assistant Examiner*—Alecia D. Nelson
*Attorney, Agent, or Firm*—Ronald P. Kananen; Rader, Fishman & Grauer

[57] ABSTRACT

A liquid crystal display device includes a liquid crystal display device, a vertical scanner, a horizontal scanner, a video driver, a timing generator, and termination means. The liquid crystal panel is provided with pixels arranged in a matrix. The vertical scanner operates in accordance with a first start-pulse signal, and sequentially selects each row of the pixels. The horizontal scanner operates in accordance with a second start-pulse signal, and sequentially writes a video signal to the selected row of the pixels by distributing the video signal to each column of the pixels. The video driver, which is activated in accordance with supply of power, supplies the video signal to the liquid crystal panel. The timing generator, which is activated in accordance with the supply of power, supplies the first start-pulse signal and the second start-pulse signal to the vertical scanner and the horizontal scanner, respectively. The termination circuit terminates at least either of the first start-pulse signal and the second start-pulse signal which are repeatedly inputted to the vertical scanner and the horizontal scanner until the video signal outputted from the video driver becomes stable when power is supplied.

8 Claims, 7 Drawing Sheets

LIQUID CRYSTAL DISPLAY DEVICE AND A METHOD FOR DRIVING THE SAME

BACKGROUND OF THE INVENTION

1. Field of the Invention

The present invention relates to active-matrix liquid crystal display devices and methods for driving the devices, and in particular to an activation control technique used when power is supplied.

2. Description of the Related Art

FIG. 9 shows a general block diagram of a conventional liquid crystal display device. This liquid crystal display device includes a video driver 101, a timing generator 102, a voltage regulation circuit 103, and a liquid crystal panel 104. The video driver 101 performs synchronous separation and decoding by processing a video signal "VIDEO" inputted from the exterior. A synchronizing signal "SYNC" obtained by synchronous separation is sent to the timing generator 102. The timing generator 102 reversely supplies a field reverse pulse signal "FRP" to the video driver 101. The video driver 101, which includes a driver unit, converts a video signal demodulated by decoding, into ac video signals "$V_{sig}$" for driving liquid crystal in accordance with the field reverse pulse signal FRP. These ac video signals $V_{sig}$ consist of three primary color components: red, green and blue, which are outputted. The timing generator 102 generates various timing signals in accordance with the synchronizing signal SYNC in addition to the above field reverse pulse signal FRP. The timing signals include horizontal start-pulse signal "HST", horizontal clock signals "HCK1" and "HCK2", vertical start-pulse signal "VST", and vertical clock signals "VCK1" and "VCK2", which are all supplied to the liquid crystal panel 104. The voltage regulation circuit 103 supplies counter voltage "$V_{com}$" to the liquid crystal panel 104. The liquid crystal panel is provided with a counter electrode and pixel electrodes both in contact with a liquid crystal layer. The counter voltage $V_{com}$ is applied to the counter electrode, while the video signals $V_{sig}$ are applied to the pixel electrodes. The liquid crystal panel 104 is provided with liquid crystal pixels arranged in a matrix between the counter electrode and the pixel electrodes. Since the liquid crystal panel 104 is a built-in peripheral driving circuit type, it includes a vertical scanner and a horizontal scanner. The vertical scanner, which operates in accordance with the vertical start-pulse signal VST, sequentially selects each row of the liquid crystal pixels. The horizontal scanner, which operates in accordance with the horizontal start-pulse signal HST, writes the video signals $V_{sig}$ to the selected row of the liquid crystal pixels by sequentially distributing them to each column of the liquid crystal pixels.

As described above, the liquid crystal display device is driven by applying the video signals $V_{sig}$, the counter voltage $V_{com}$, and various timing signals including the horizontal start-pulse signal HST and the vertical start-pulse signal VST to the liquid crystal panel 104. Predetermined power voltages are also supplied to the horizontal scanner and the vertical scanner which are built into the liquid crystal panel 104. According to a conventional device, the video driver 101, the timing generator 102 and the voltage regulation circuit 103 are activated at the same time when the power is supplied. However, when the power is supplied, the way in which the video signals, the timing signals and the counter voltage rise is not regular due to the characteristics of integrated circuits included in the video driver 101, the timing generator 102 and the voltage regulation circuit 103.

After the video driver 101, the timing generator 102 and the voltage regulation circuit 103 have been activated, the video signals $V_{sig}$ and the counter voltage $V_{com}$ reach their stable conditions through their transition conditions. These changes are shown on a graph in FIG. 10. On the graph the horizontal axis represents time t with one graduation set to 20 ms, and the vertical axis represents voltage with one graduation set to 5 V. As can be seen, after the supply of power, the counter voltage $V_{com}$ gradually rises from the ground level (GND) to reach its normal level (for example, in proximity to 6 V). The video driver 101 outputs a dc voltage exceeding 10 V until its operation becomes stable after it has been activated. After that, the output is switched to the predetermined video signal. The graph shows that, after the supply of power, the output voltage of the video driver 101 rises to a dc voltage level exceeding 10 V from the ground level GND, relatively faster than the counter voltage $V_{com}$. In other words, a relative delay is generated while both are rising. The delay is in the order of, for example, 10 to 100 ms.

FIG. 11 shows a graph of the potential difference ($V_{com}$–$V_{sig}$) between the counter electrode potential and the pixel electrode potential, on which an effective driving voltage applied to the liquid crystal pixels is shown. On the graph the horizontal axis represents time t with one graduation set to 50 ms, and the vertical axis represents voltage with one graduation set to 5 V. In an initial phase after starting the supply of power, the effective voltage falls in proximity to −10 V, which causes application of an excessive dc component. This excessive dc component corresponds to the relative delay in the rise of the signal voltage $V_{sig}$ with respect to the counter voltage $V_{com}$ as shown on the graph in FIG. 10. In other words, the signal voltage rises to a dc level exceeding 10 V before the potential of the counter electrode reaches the vicinity of 6 V as its normal level, thus, the excessive dc component is transitionally applied to the liquid crystal pixels. Subsequently, the effective driving voltage applied to the liquid crystal pixels shifts to a stable condition through an unstable condition. In the stable condition an ac signal applied to the liquid crystal pixels includes a dc component. Transition from the start of the supply of power to the stable condition requires a period of 10 to 200 ms. The dc voltage is applied to the liquid crystal pixels in this manner until operation of the video driver for generating the video signals becomes stable after starting the power supply. The application of the dc voltage causes temporary irregularity in the orientation of the liquid crystal, which results in such significant display deterioration as to show luminescent spot defects over the screen. Such irregularity in the orientation of the liquid crystal may remain even after the dc component has been removed. According to the conventional art, the above-described problem occurs whenever the liquid crystal display device is activated, which causes not only display deterioration but also reliability deterioration. Accordingly, one of the problems to be solved is to improve reliability. The screen looks as if it has luminescent spot defects over its entire area for a period of time after starting the supply of power. Thus, in this unstable condition, measures to control the screen so the spots are seen by de-activating a backlight are taken. However, the measures are not effective in maintaining reliability because they are not fundamental and cannot prevent the dc component from being applied to the liquid crystal.

SUMMARY OF THE INVENTION

In view of the above-described problems in the related art, it is an object of the present invention to provide both a liquid crystal display device and a method for driving the device which can prevent an inferior display from occurring when power is supplied.

To this end, according to an aspect of the present invention, the foregoing object has been achieved through the provision of a liquid crystal display device including: a liquid crystal panel having pixels arranged in a matrix; a vertical scanner operating in accordance with a first start-pulse signal, for sequentially selecting each row of the pixels; a horizontal scanner operating in accordance with a second start-pulse signal, for sequentially writing a video signal to the selected row of the pixels by distributing the video signal to each column of the pixels; a video driver to be activated in accordance with supply of power, for supplying the video signal to the liquid crystal panel; a timing generator to be activated in accordance with the supply of power, for supplying the first start-pulse signal and the second start-pulse signal to the vertical scanner and the horizontal scanner, respectively; and termination means for terminating at least either of the first start-pulse signal and the second start-pulse signal which are repeatedly inputted to the vertical scanner and the horizontal scanner until the video signal outputted from the video driver becomes stable when power is supplied.

Preferably, the termination means terminates both the first start-pulse signal and the second start-pulse signal, or includes an external component capable of variably setting the termination period of the start-pulse signal in accordance with the time spent until the video signal becomes stable.

The external component may include a capacitor for determining the time constant of an integration circuit.

The termination means may include a power-voltage detection circuit, a delay circuit for setting the time spent until the video signal becomes stable, and a pulse termination circuit for terminating output of the start-pulse signal during the time set by the delay circuit.

The vertical scanner and the horizontal scanner may be incorporated in the liquid crystal panel.

According to another aspect of the present invention, the foregoing object has been achieved through the provision of a method for driving a liquid crystal display device having pixels arranged in a matrix, the method including the steps of: sequentially selecting each row of pixels in accordance with a first start-pulse signal; sequentially writing a video signal to the selected row of pixels by distributing the video signal to each column of pixels in accordance with a second start-pulse signal; supplying the video signal in accordance with supply of power; repeatedly supplying the first start-pulse signal and the second start-pulse signal in accordance with the supply of power; and terminating at least either the first start-pulse signal or the second start-pulse signal until the video signal becomes stable when power is supplied.

Preferably, the method includes the step of terminating both the first start-pulse signal and the second start-pulse signal.

As described above, according to the present invention, by terminating the first start-pulse signal and the second start-pulse signal which are repeatedly inputted to the vertical scanner and the horizontal scanner until the video signal becomes stable, writing an unstable video signal to the liquid crystal pixels can be prevented. Thereby, the application of a dc voltage to the liquid crystal pixels can be prevented, which can suppress occurrence of inferior display and improve reliability.

DESCRIPTION OF THE PREFERRED EMBODIMENT

An optimum embodiment of the present invention will be described by referring to the attached drawings.

Figure 1:
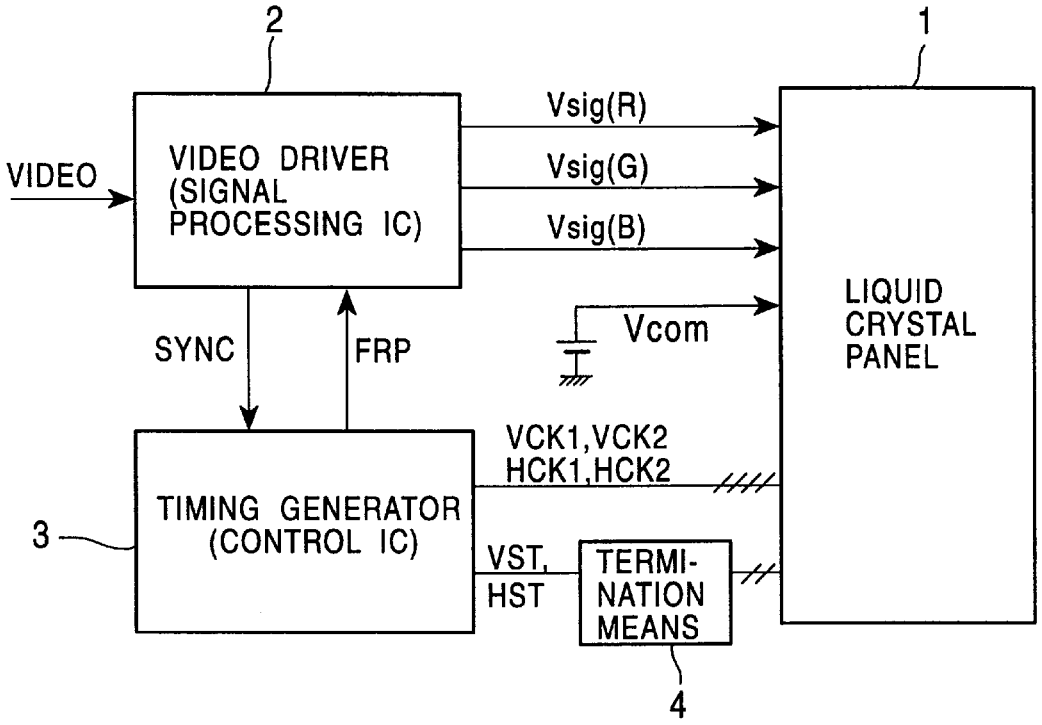
FIG. 1 is a basic block diagram showing a liquid crystal display device according to the present invention.

FIG. 1 shows a basic block diagram of a liquid crystal device according to the present invention. The liquid crystal device includes a liquid crystal panel 1, a video driver 2, a timing generator 3 and termination means 4. The liquid crystal panel 1 includes liquid crystal pixels arranged in a matrix, a vertical scanner which is activated in accordance with a first start-pulse signal (vertical start-pulse signal) VST and sequentially selects each row of the liquid crystal pixels, and a horizontal scanner which is activated in accordance with second start-pulse signal (horizontal start-pulse signal) HST and writes a video signal to the selected row of the liquid crystal pixels by sequentially distributing the video signals to each column of the liquid crystal pixels. The liquid crystal panel 1 is provided with a counter electrode to which counter voltage $V_{com}$ is applied. The video driver 2 includes a signal processing integrated circuit. The video driver 2 is supplied with power to operate, and supplies video signals $V_{sig}$ to the scanners of the liquid crystal panel 1. The video signals $V_{sig}$ are separate corresponding to three primary colors: red, green and blue. The video driver 2 includes a decoder unit, and performs synchronous separation and demodulation on a video signal VIDEO inputted from the exterior. A separated synchronizing signal SYNC is supplied to the timing generator 3. The video driver 2 also includes a driver unit, and outputs video signals $V_{sig}$ in accordance with a field reverse pulse signal FRP supplied from the timing generator 3. The timing generator 3 includes a control integrated circuit, and is activated by supply of power. The timing generator 3 supplies the vertical and horizontal scanners in the liquid crystal panel 1 with the vertical start-pulse signal VST and horizontal start-pulse signal HST, based on synchronizing signal SYNC. The timing generator 3 further generates various timing signals such as vertical clock signals VCK1, VCK2, and horizontal clock signals HCK1, HCK2. The termination means 4 is provided between the timing generator 3 and the liquid crystal panel 1, and prevents unstable video signals $V_{sig}$ from being written to the liquid crystal pixels until video signals $V_{sig}$ become stable when power is supplied, by terminating at least either of the vertical start-pulse signal VST and horizontal start-pulse signal HST, which are repeatedly inputted to the vertical scanner and the horizontal scanner. In this embodiment the termination means 4 terminates both vertical start-pulse signal VST and horizontal start-pulse signal HST. Preferably, the termination means 4 includes an external component capable of variably setting the termination period of the start-pulse signals in accordance with the time spent until video signals $V_{sig}$ become stable.

Figure 2:
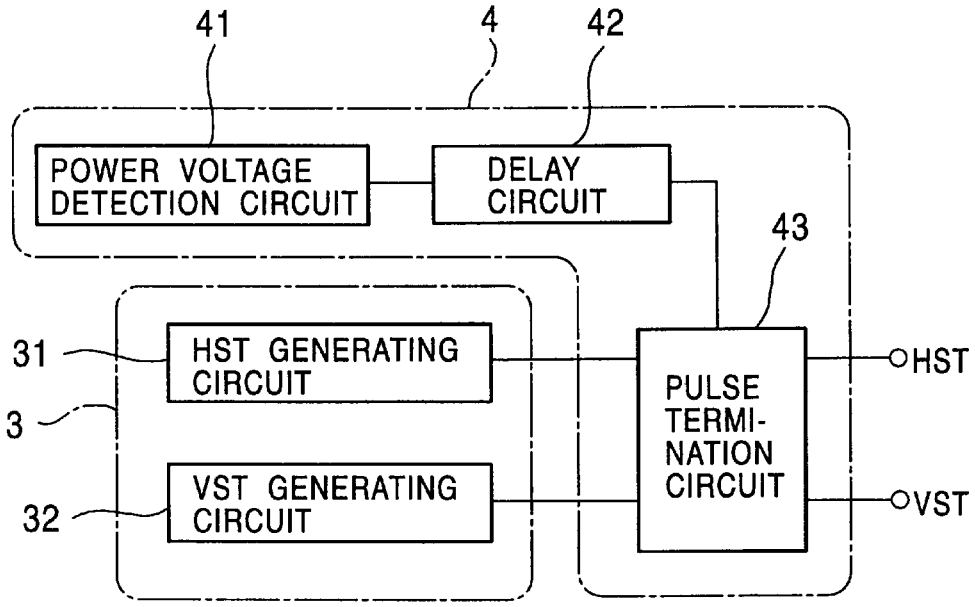
FIG. 2 is a detailed block diagram showing termination means included in the liquid crystal display device shown in FIG. 1.

FIG. 2 shows a detailed block diagram of the termination means 4 shown in FIG. 1. The termination means 4 includes a power-voltage detection circuit 41, a delay circuit 42, and a pulse termination circuit 43. The timing generator 3 includes an HST generating circuit 31 and a VST generating circuit 32. The power-voltage detection circuit 41 detects whether power has been supplied. The delay circuit 42 determines the time spent until the video signals become stable. This time varies with the characteristics of the signal processing IC included in the video driver 2, and is approximately 100 to 200 ms. The pulse termination circuit 43 is provided in the output stages of the HST generating circuit 31 and the VST generating circuit 32, and terminates output of horizontal start-pulse signal HST and vertical start-pulse signal VST during the time determined by the delay circuit 42 after the start of the power supply.

Figure 3:
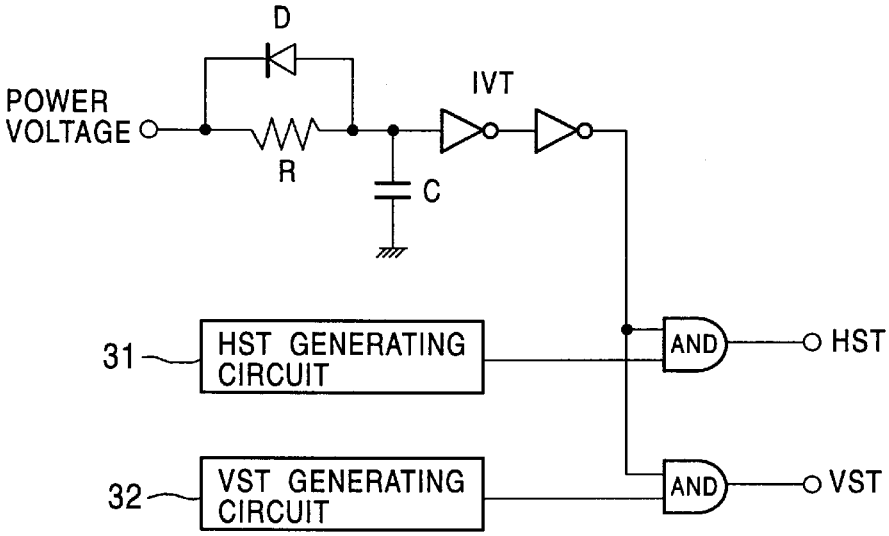
FIG. 3 is a further detailed circuit diagram showing the termination means.

FIG. 3 shows a more detailed circuit diagram of the termination means 4. An integration circuit is comprised of a resistor R and a capacitor C, and determines the termination period of horizontal and vertical start-pulse signals HST and VST. An external component is used as the capacitor C which is one of elements determining the time constant of the integration circuit, so the termination period can be optionally determined. A combination of the resistor R, the capacitor C and two inverters IVT forms a so-called power-on-reset circuit, which outputs a reset-pulse signal after a lapse of a predetermined time after the start of the power supply. AND-gate devices connected to the output stages of the HST generating circuit 31 and the VST generating circuit 32 are activated in accordance with the reset pulses. Thereby, after a lapse of the predetermined time, horizontal and vertical start-pulse signals HST and VST are supplied to the liquid crystal panel 1. A diode D connected to both ends of the resistor R is provided to prevent a malfunction occurring when the power is repeatedly switched on and off. In this embodiment the pulse termination control is performed by connecting the AND-gate devices to the output stages of the HST generating circuit 31 and the VST generating circuit 32, however, the present invention is not limited thereto. The HST generating circuit 31 or the VST generating circuit 32 may include a pulse termination circuit.

Figure 4:
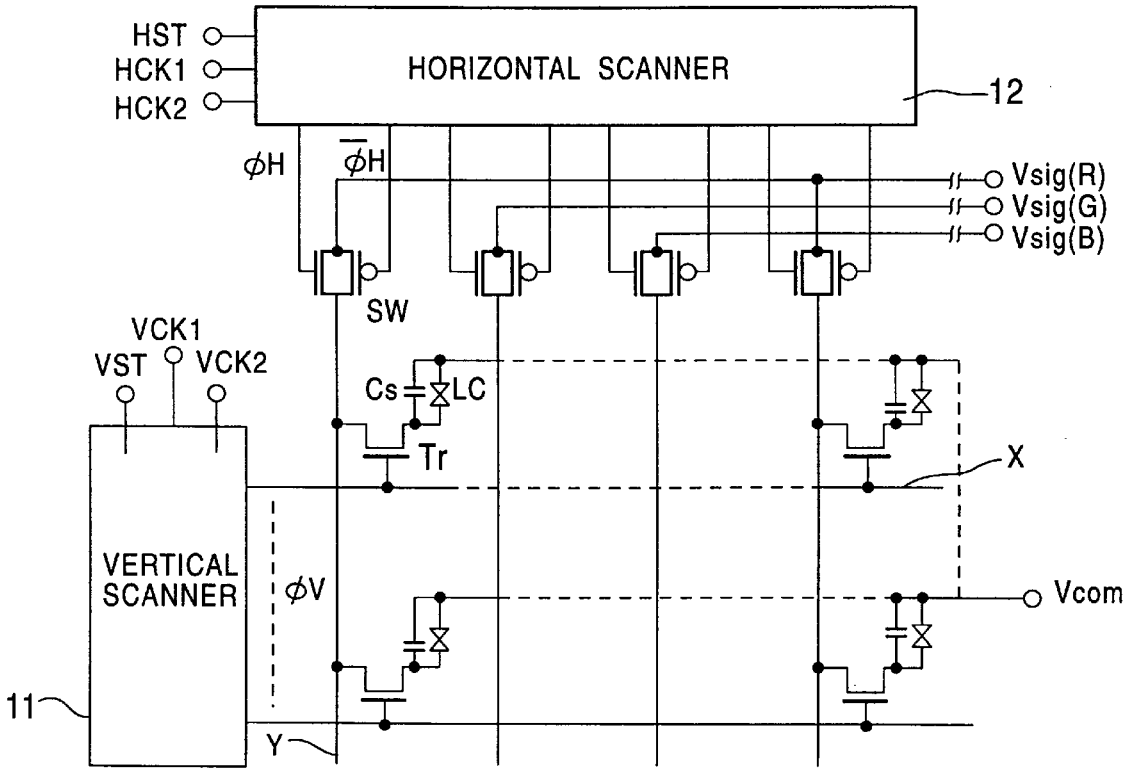
FIG. 4 is a detailed circuit diagram showing a liquid crystal panel included in the liquid crystal display device shown in FIG. 1.

FIG. 4 shows a detailed block diagram of the liquid crystal panel 1 shown in FIG. 1. The liquid crystal panel 1 is provided with the liquid crystal pixels LC arranged in a matrix. The liquid crystal pixels LC have the counter electrode and the pixel electrodes with a liquid crystal layer provided therebetween. The above-described counter voltage $V_{com}$ is applied to the counter electrode. Additional capacitors C are connected in parallel to the respective liquid crystal pixels LC. The pixel electrodes for the liquid crystal pixels LC are connected to driving transistors Tr. The gate electrodes of the respective transistors are connected to gate lines X extending along the row direction, the source electrodes are connected to signal lines Y extending along the column direction, and the drain electrodes are connected to the pixel electrodes corresponding thereto. The gate lines X are connected to the vertical scanner 11. The vertical scanner 11 receives vertical start-pulse signal VST, and vertical clock signals VCK1, VCK2 from the timing generator 2 shown in FIG. 1. In addition, the respective signal lines Y are connected to input signal lines via analog switches SW, and receive video signals $V_{sig}$. The respective analog switches SW are turned on or off in accordance with sampling pulses $\phi_H$ outputted from the horizontal scanner 12. The horizontal scanner 12 receives horizontal start-pulse signal HST and horizontal clock signals HCK1, HCK2 supplied from the timing generator 3.

The vertical scanner 11 sequentially transfers vertical start-pulse signal VST in accordance with vertical clock signals VCK1 and VCK2, and outputs selection pulses $\phi_V$ every horizontal period (1 H) to select one gate line X. The horizontal scanner 12 sequentially transfers horizontal start-pulse signal HST in accordance with bi-phase horizontal clock signals HCK1 and HCK2, and sequentially outputs sampling pulses $\phi_H$ within one horizontal period to turn on or off all the analog switches SW. As a result, if video signals $V_{sig}$ are written to the respective liquid crystal pixels LC, and a potential difference with respect to the counter voltage $V_{com}$ is generated, which provides a desired image display.

In this embodiment the active matrix liquid crystal panel is used, but the present invention is not limited thereto but can be applied to, for example, simple matrix liquid crystal panels. In this case vertical and horizontal scanners need to be external components. A normally-while-white-mode liquid-crystal panel or a normally-black-mode liquid-crystal panel may be used. In order for the liquid crystal panel to be reflective, a reflector is mounted on the back of the liquid=crystal panel. In order for the liquid crystal panel to be transmissive, a backlight is used. The liquid crystal panel shown in FIG. 4 uses tri-terminal devices including thin-film transistors as active elements for driving the pixels, however, the present invention is not limited thereto but bi-terminal devices such as MIMs may also be used. The liquid crystal panel shown in FIG. 4 has built-in peripheral circuits such as the horizontal and vertical scanners, however, the present invention is not limited thereto but can be applied to an active matrix liquid crystal panel with its horizontal and vertical scanners provided externally.

Figure 5:
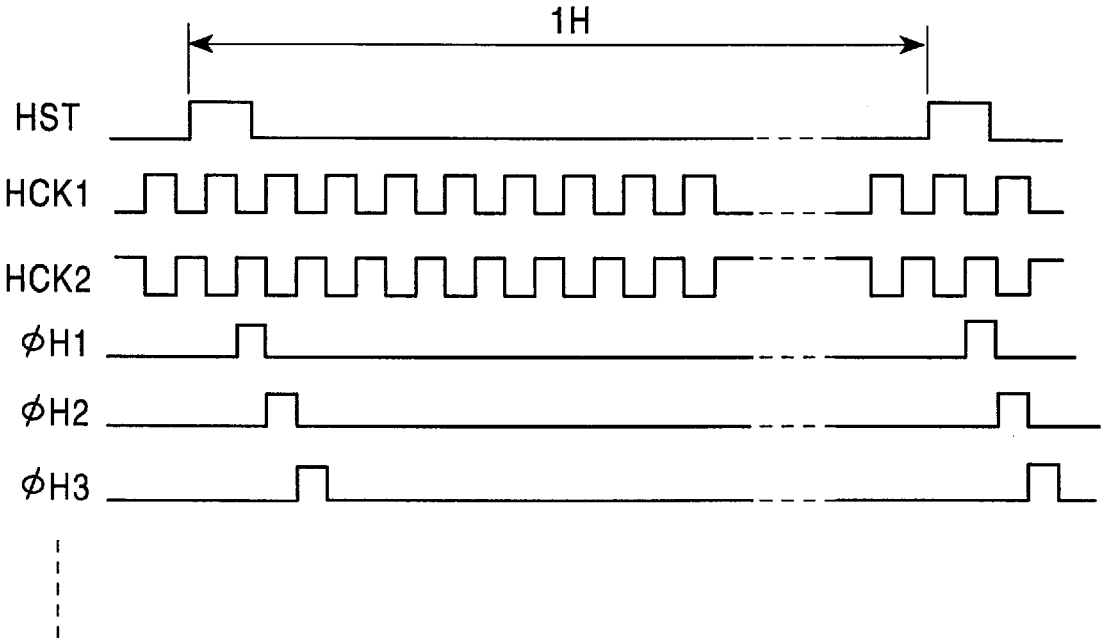
FIG. 5 is a timing chart showing inputs and outputs of a horizontal scanner included in the liquid crystal display device shown in FIG. 1.

FIG. 5 shows a timing chart of inputs and outputs of the horizontal scanner 12 shown in FIG. 4. The horizontal scanner 12 operates based on horizontal start-pulse signal HST and horizontal clock signals HCK1, HCK 2, both generated by the timing generator 3, and sequentially outputs sampling pulses $\phi_{H1}$, $\phi_{H2}$,$\phi_{H3}$, . . . during one horizontal period. Accordingly, the video signals are sequentially sampled to be supplied to the signal lines.

Figure 6:
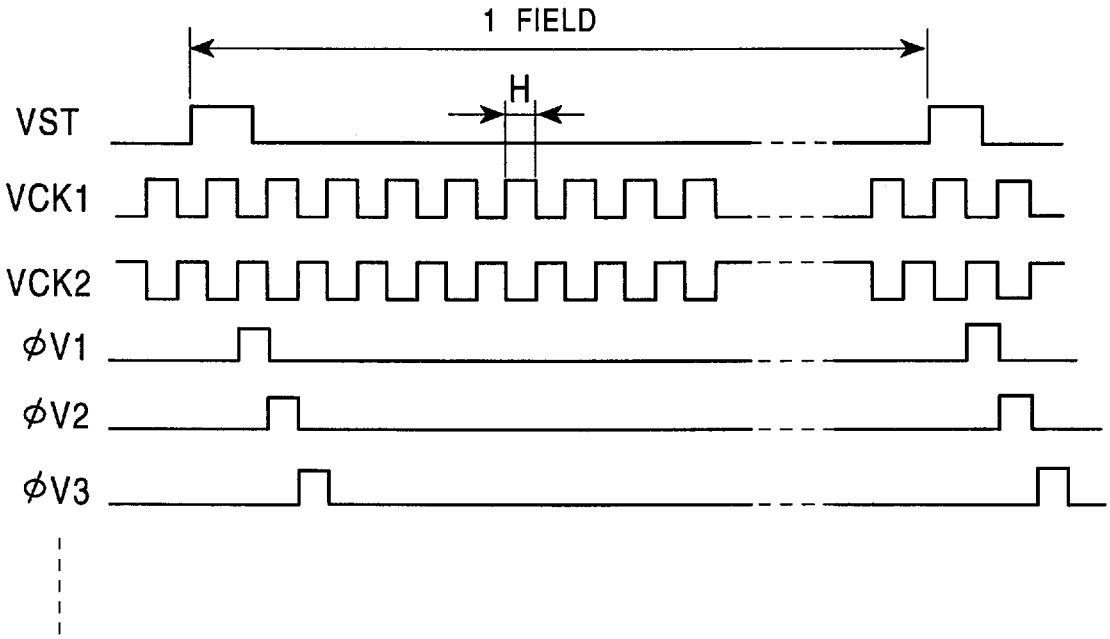
FIG. 6 is a timing chart showing inputs and outputs of a vertical scanner included in the liquid crystal display device shown in FIG. 1.

FIG. 6 shows a timing chart of inputs and outputs of the vertical scanner 11 shown in FIG. 4. The vertical scanner 11 sequentially transfers vertical start-pulse signal VST supplied from the timing generator 3 in accordance with vertical clock signals VCK1 and VCK2 supplied from the timing generator 3, and sequentially outputs selection pulses $\phi_{V1}$, $\phi_{V2}$, $\phi_{V3}$, . . . over one field. In accordance with the selection pulses, each row of the pixel driving transistors Tr becomes conductive. As a result, the video signals $V_{sig}$ written to the signal lines X are written to the liquid crystal pixels LC via the transistors Tr which are conductive, thus, an image is displayed.

Figure 7:
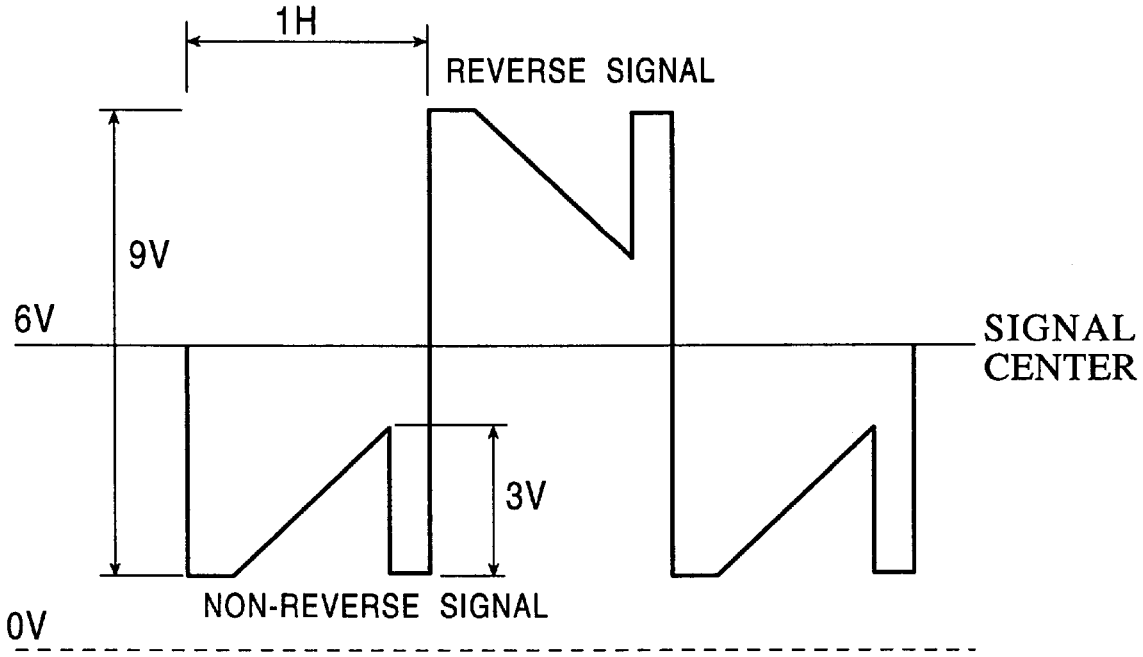
FIG. 7 is a waveform chart showing one example of video signals outputted from a video driver included in the liquid crystal display device shown in FIG. 1.
Figure 10:
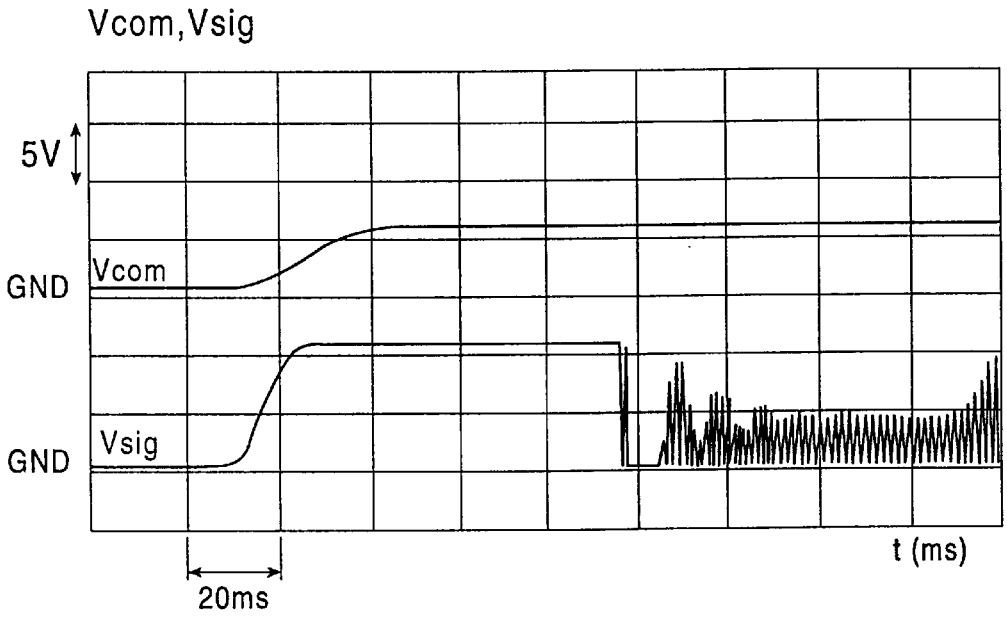
PRIOR ART FIG. 10
FIG. 10 is a graph showing time-related changes in counter voltage $V_{com}$ and video signal $V_{sig}$.
Figure 11:
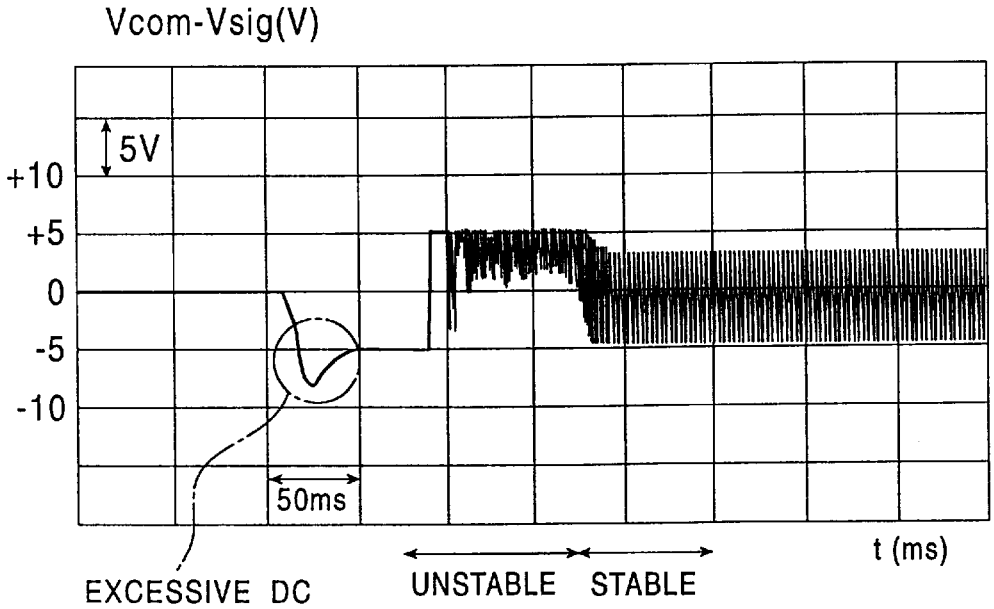
PRIOR ART FIG. 11
FIG. 11 is a graph showing time-related changes in effective voltage applied to liquid crystal pixels.

FIG. 7 shows a waveform chart of the video signals $V_{sig}$ supplied to the liquid crystal panel 1 from the video driver 2. The video signal is vertically symmetrical with respect to a certain dc potential (signal center). The polarity of the video signal reverses with reference to the signal center every horizontal period. By setting the counter voltage $V_{com}$ (applied to the counter electrode on the liquid crystal panel 1) to approximately the same value as the signal center, the liquid crystal pixels LC can be driven with the dc component excluded. However, as shown in FIGS. 10 and 11, the video signal which must be vertically symmetric with respect to the signal center when the power is supplied is asymmetric. Thus, the dc component is applied to the liquid crystal pixels. Therefore, according to the present invention, by providing the termination means 4 between the timing generator 3 and the liquid crystal panel 1 to temporarily break horizontal start-pulse signal HST and vertical start-pulse signal VST, writing the video signals to the liquid crystal panel 1 is temporarily terminated, which can prevent the dc component from being applied to the liquid crystal pixels.

Figure 8:
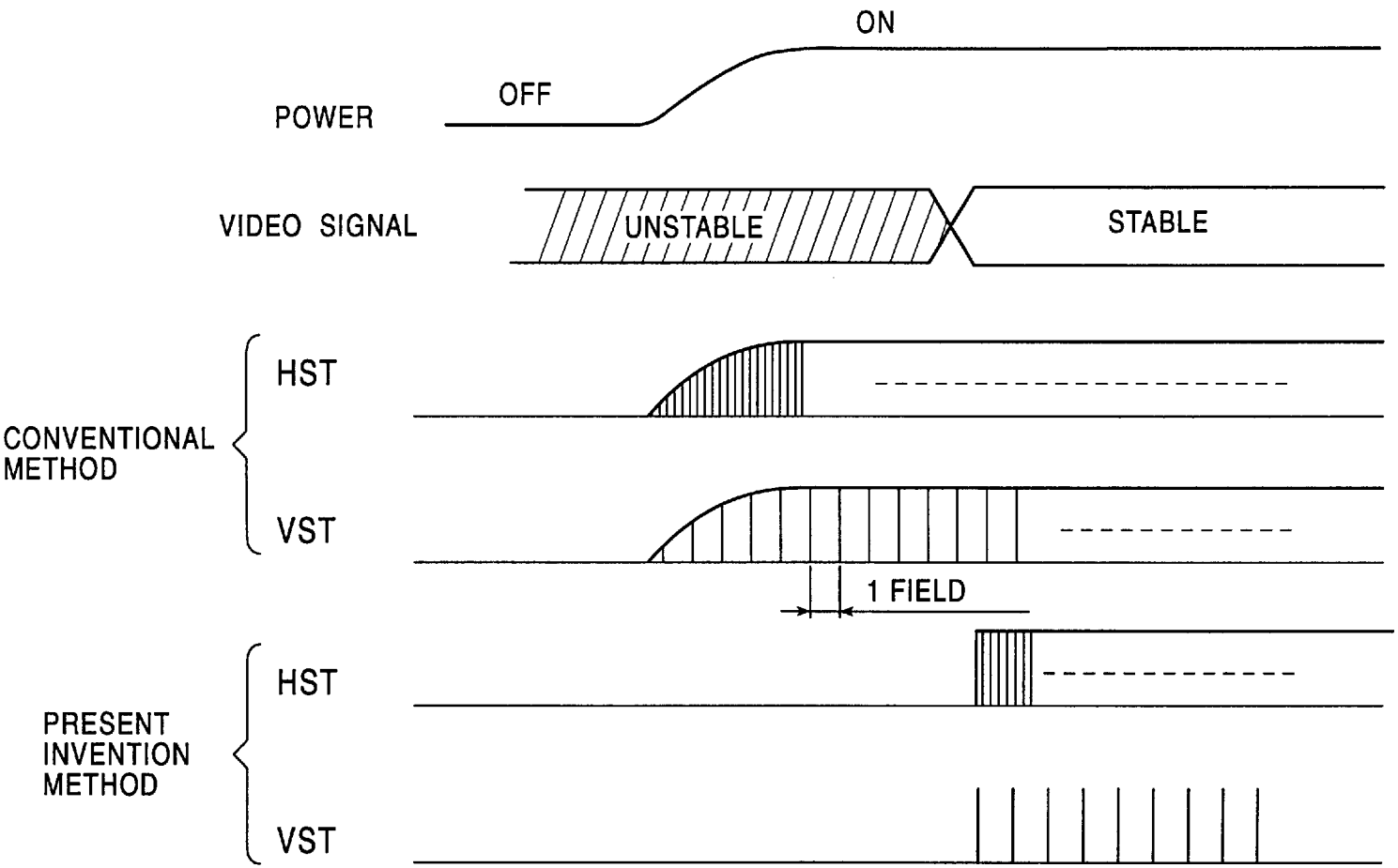
FIG. 8 is a timing chart showing operations of the liquid crystal display device shown in FIG. 1.
Figure 9:
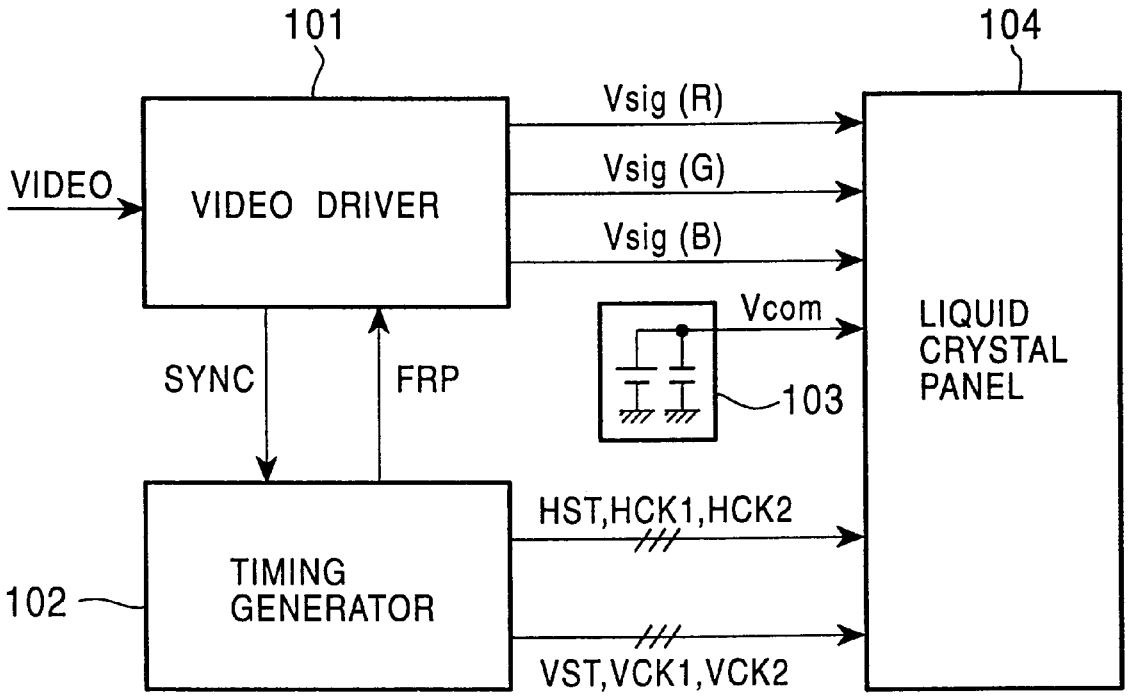
PRIOR ART FIG. 9
FIG. 9 is a block diagram showing one example of a conventional liquid crystal device.

FIG. 8 shows a timing chart in which operations of the liquid crystal display device according to the present invention are illustrated. As can be seen, after the start of the power supply, the power voltage gradually rises to reach the normal condition. The video signals outputted from the video driver 2 are unstable for a period of time after the start of the power supply, and reach the stable condition after a lapse of 100 to 200 ms. At this time, according to the conventional method, when the power is supplied, horizontal and vertical start signals HST and VST are simultaneously supplied to the liquid crystal panel. Consequently, the video signals, which are unstable, are written to the pixels of the liquid crystal panel 1. On the contrary, the driving method of the present invention prevents horizontal and vertical start signals HST and VST from being outputted while the video signals are unstable, thus, the unstable video signals are not written to the liquid crystal panel 1. As a result, the quality of the display does not deteriorate and no problems occur in reliability.

In this embodiment, both horizontal and vertical start-pulse signals HST and VST are temporarily terminated, but the present invention is not limited thereto. Even when either start-pulse signal HST or VST is terminated, unstable video signals are not written to the liquid crystal panel. However, when only vertical start-pulse signal VST is terminated, the unstable video signals are sampled up to the signal lines of the liquid crystal panel 1. Thus, if the liquid crystal panel 1 includes the signal lines Y and the pixel electrodes with both positioned in extremely close proximity, it is possible that a defect, like inclusion of signal voltage occur. In addition, when only horizontal start-pulse signal HST is terminated and charges accumulated in the signal lines X of the liquid crystal panel remain (for example, when the power has been switched off and successively on), the charges are written to the liquid crystal pixels, which may cause an indefinite display. Therefore, it is ideal to terminate both horizontal and vertical start signals HST and VST.

What is claimed is:

1. A liquid crystal display device comprising:

a liquid crystal panel having a plurality of pixels arranged in a matrix having a plurality of rows and columns;

a vertical scanner operating in accordance with a first start-pulse signal, for sequentially selecting each row of said pixels;

a horizontal scanner operating in accordance with a second start-pulse signal, for sequentially writing a video signal to the selected row of said pixels by distributing said video signal to each column of said pixels;

a video driver to be activated in accordance with supply of power, for supplying said video signal to said liquid crystal panel;

a timing generator to be activated in accordance with the supply of power, for supplying said first start-pulse signal and said second start-pulse signal to said vertical scanner and said horizontal scanner, respectively; and termination means for terminating at least one of said first start,pulse signal and said second start-pulse signal, which are repeatedly inputted to said vertical scanner and said horizontal scanner, until said video signal outputted from said video driver becomes stable when power is supplied.

2. A liquid crystal display device according to claim 1, wherein said termination means terminates both said first start-pulse signal and said second start-pulse signal.

3. A liquid crystal display device according to claim 1, wherein said termination means includes an external component capable of variably setting the termination period of said start-pulse signal in accordance with time spent until said video signal becomes stable.

4. A liquid crystal display device according to claim 3, wherein said external component comprises a capacitor for determining the time constant of an integration circuit.

5. A liquid crystal display device, comprising:

a liquid crystal panel having a plurality of pixels arranged in a matrix having a plurality of rows and columns;

a vertical scanner operating in accordance with a first start-pulse signal, for sequentially selecting each row of said pixels;

a horizontal scanner operating in accordance with a second start-pulse signal, for sequentially writing a video signal to the selected row of said pixels by distributing said video signal to each column of said pixels;

a video driver to be activated in accordance with supply power, for supplying said video signal to said liquid crystal panel;

a timing generator to be activated in accordance with the supply of power, for supplying said first start-pulse signal and said second start-pulse signal to said vertical scanner and said horizontal scanner, respectively; and termination means for at least one of said first start-pulse signal and said second start-pulse signal, which are repeatedly inputted to said vertical scanner and said horizontal scanner, until said video signal outputted from said video driver becomes stable when power is supplied, said termination means including a power-voltage detection circuit, a delay circuit for setting time spent until said video signal becomes stable, and a pulse termination circuit for terminating output of said start-pulse signal during the time set by said delay circuit.

6. A liquid crystal display device according to claim 1, wherein said vertical scanner and said horizontal scanner are incorporated in said liquid crystal panel.

7. A method for driving a liquid crystal display device having pixels arranged in a matrix having a plurality of rows and columns, said method comprising the steps of:

sequentially selecting each row of pixels in accordance with a first start-pulse signal;

sequentially writing a video signal to the selected row of pixels by distributing said video signal to each column of pixels in accordance with a second start-pulse signal;

supplying said video signal in accordance with supply of power;

repeatedly supplying said first start-pulse signal and said second start-pulse signal in accordance with the supply of power; and terminating at least one of said first start-pulse signal and said second start-pulse signal until said video signal becomes stable when power is supplied.

8. A method for driving a liquid crystal display device, according to claim 7, wherein said method terminates both said first start-pulse signal and said second start-pulse signal.

* * * * *

UNITED STATES PATENT AND TRADEMARK OFFICE

CERTIFICATE OF CORRECTION

PATENT NO. : 6,057,822
DATED : May 2, 2000
INVENTOR(S) : Hiroyoshi Tsubota

It is certified that error appears in the above-identified patent and that said Letters Patent is hereby corrected as shown below:

Column 8, claim 5,
Line 29, should read;

-- a video driver to be activated in accordance with the supply of power --.
Line 36, should read;

-- termination means for terminating at least one of said first start-pulse --.

Signed and Sealed this

Fifth Day of February, 2002

*Attest:*

*Attesting Officer*

JAMES E. ROGAN
*Director of the United States Patent and Trademark Office*